US006928843B1

(12) United States Patent
Pirnie

(10) Patent No.: US 6,928,843 B1
(45) Date of Patent: Aug. 16, 2005

(54) SEAL ENCLOSURE ASSEMBLY FOR CARGO DOORS

(76) Inventor: James T. Pirnie, 919 E. Phoenix, Grand Island, NE (US) 68801

( * ) Notice: Subject to any disclaimer, the term of this patent is extended or adjusted under 35 U.S.C. 154(b) by 40 days.

(21) Appl. No.: 10/836,846

(22) Filed: Apr. 30, 2004

Related U.S. Application Data

(60) Provisional application No. 60/512,589, filed on Oct. 17, 2003, provisional application No. 60/551,513, filed on Mar. 9, 2004.

(51) Int. Cl.[7] ..... E05B 67/38

(52) U.S. Cl. ..... 70/54; 70/56; 70/203; 70/212; 292/205; 292/284; 292/307 B; 292/DIG. 2; 292/DIG. 32

(58) Field of Search ..... 70/54–56, DIG. 43, 70/DIG. 56, 129, 417, 203, 211, 212; 292/DIG. 2, 292/DIG. 32, 205, 208, 211, 307 B, 148, 292/281, 282, 284, 286, 287, 328–331

(56) References Cited

U.S. PATENT DOCUMENTS

| | | | | |
|---|---|---|---|---|
| 3,563,069 | A * | 2/1971 | Ferrer | 70/129 |
| 4,031,719 | A * | 6/1977 | Klingler et al. | 70/56 |
| 4,068,505 | A * | 1/1978 | Volk, Jr. | 70/56 |
| 4,106,315 | A * | 8/1978 | Dohanyos | 70/56 |
| 4,286,814 | A * | 9/1981 | Harrington et al. | 292/281 |
| 4,372,138 | A * | 2/1983 | De Forrest | 70/56 |
| 4,437,692 | A * | 3/1984 | Halopoff | 292/57 |
| 4,898,008 | A | 2/1990 | Eberly | 70/56 |
| 4,905,486 | A * | 3/1990 | Appelbaum | 70/54 |
| 5,118,149 | A | 6/1992 | Emmons | 292/327 |
| 5,154,458 | A | 10/1992 | Cook et al. | 292/218 |
| 5,168,258 | A | 12/1992 | Radke | 340/542 |
| 5,444,998 | A * | 8/1995 | James | 70/14 |
| 5,743,118 | A | 4/1998 | Anderson | 70/56 |
| 6,581,419 | B1 | 6/2003 | Strodtman | 70/56 |

OTHER PUBLICATIONS

*Plastic Padlock with Secur-Hasp II Seal*: Seton; © 1995-2002 Tricor Direct, Box 3307, Markham Ontario, Canada L3R 6G6; http://catalogue.seton.ca/J56.html: Oct. 14, 2003; 1 page.

*Hasp Lok Security Seal*; http://www.safconsecurityseal.com/english/products/hasp/; Oct. 14, 2003; 2 pages.

(Continued)

*Primary Examiner*—Lloyd A. Gall
(74) *Attorney, Agent, or Firm*—Suiter West PC LLO

(57) ABSTRACT

An enclosure assembly for enclosing a tamper-evident security seal sealing a hasp assembly comprises a first enclosure portion and a second enclosure portion. A post is coupled to the first enclosure portion for extending through the generally aligned holes of the hasp members of the hasp assembly to secure the hasp members together and position the first enclosure portion behind the security seal. The second enclosure portion includes an aperture formed therein for receiving the post so that the second enclosure member engages the first enclosure portion and covers the security seal. In this manner, the first enclosure portion and the second enclosure portion cooperate to at least substantially enclose the security seal. A latching member secures the second enclosure portion to the first enclosure to limit unauthorized access to the security seal.

25 Claims, 13 Drawing Sheets

OTHER PUBLICATIONS

*Steel Padlock Seal—Model WP101*; American Casting & Manufacturing Corporation; http://www.americancasting-.com/products.asp?cat_id=15&prod_id=23; Oct. 14, 2003; 2 pages.

*Padlock Seals*; American Casting & Manufacturing Corporation; © 2002 by American Casting & Manufacturing Corporation, 51 Commercial Street, Plainview, New York 11803, USA; 1-800-342-0333; 2 pages.

*Tamper-Indicating Seals for Nuclear Disarmament and Hazardous Waste Management* by Roger G. Johnston, team Leader, Vulnerability Assessment Team, Los Alamos National Laboratory, Los Alamos, NM; Science & Global Security, vol. 9, pp. 93-112; © 2001 Taylor and Francis; 20 pages.

* cited by examiner

SEAL ENCLOSURE ASSEMBLY FOR CARGO DOORS

CROSS-REFERENCE TO RELATED APPLICATIONS

The present application claims the benefit under 35 U.S.C. § 119(e) of U.S. Provisional Application Ser. No. 60/512,589, filed Oct. 17, 2003 and Provisional Application Ser. No. 60/551,513, filed Mar. 9, 2004. Said U.S. Provisional Application Ser. Nos. 60/512,589 and 60/551,513 are herein incorporated by reference in their entirety.

FIELD OF THE INVENTION

The present invention generally relates to security devices for cargo carrying vehicles and shipping containers having a cargo door including a latching assembly comprising a vertical locking bar and a horizontally extending locking arm pivotally attached to the vertical locking bar and held against the cargo door via a hasp assembly which may be secured by a security seal extending through the hasp assembly, and more particularly to an enclosure for enclosing and protecting the security seal.

BACKGROUND OF THE INVENTION

Conventional cargo carrying vehicles and shipping containers have swing-out cargo doors that include a latching assembly comprised of a vertical locking bar and a horizontally extending locking arm pivotally attached to the vertical bar. The vertical locking bar includes a locking cam that engages a corresponding keeper in the frame surrounding the cargo door when the cargo door is closed and the locking arm is in a position parallel with the door. The locking cam is disengaged from the keeper when the locking arm is rotated to a position perpendicular to the cargo door allowing the door to be opened. Such a latching assembly 100 is illustrated in FIG. 1.

As shown in FIG. 1, the locking arm 102 of the latching assembly 100 is secured in a horizontal position parallel to the cargo door 104 by a hasp assembly 106. The hasp assembly 106 includes a backing plate 108 that is secured to the cargo door 104. Upper and lower hasp members 110 and 112 are connected to the backing plate 108. The lower hasp member 112, or staple, which is stationary, receives and supports the lever arm 102 in a horizontal position (shown) and includes a generally horizontal flange 114 protruding outwardly from the backing plate 108 away from the cargo door 104. The upper hasp member 110 includes an upper end 116 that is pivotally connected to the backing plate 108 so that the upper hasp member 110 pivots or rotates within a plane generally parallel to the cargo door 104. The upper hasp member 110 further includes a lower end 118 that extends over the lever arm 102 when the lever arm 102 is supported by the lower hasp member 112 (shown) and a second generally horizontal flange 120 protruding outwardly from the lower end 118 away from the backing plate 108 and cargo door 104. The horizontal flanges 120 and 114 of the upper and lower hasp members 110 and 112 are provided with aligned holes 122 and 124 for receiving the shackle of a padlock (not shown) for securing the lever arm 102 within the hasp assembly 106 and preventing the cargo door 104 from being opened.

Where access to the cargo is to be limited, such as when the cargo comprises foods, chemicals, hazardous wastes, or the like, a tamper-evident security seal 126 such as a ribbon seal, a padlock seal, a cable seal, or the like is installed through the aligned holes 122 and 124 of the hasp assembly 106. This seal 126 must be broken prior to opening the cargo doors 104 allowing unauthorized entry into the cargo container to be detected. However, because the security seal 126 is exposed to the environment it is subject to being damaged accidentally during transport or to being cut by a vandal when the cargo carrying vehicle or shipping container is left unattended. Consequently, even if no tampering or theft occurs, the security of the cargo may be questioned resulting in added expense to the shipper and owner of the cargo, since the cargo must be inspected to verify that no tampering or theft has occurred, diverted to less profitable uses, or destroyed.

Accordingly, it would be desirable to provide an enclosure for enclosing and protecting tamper-evident security seals used for securing the latching assembly of the cargo doors of cargo carrying vehicles and cargo containers thereby preventing the seal from being damaged accidentally during transport or from being cut by a vandal when the cargo carrying vehicle or shipping container is left unattended.

SUMMARY OF THE INVENTION

The present invention is directed to an enclosure assembly for enclosing a tamper-evident security seal sealing a hasp assembly of the latch assembly employed, for example, by the cargo doors of a cargo carrying vehicle, a cargo container, or the like, wherein the security seal extends though generally aligned holes formed in first and second hasp members of the hasp assembly. In exemplary embodiments, the enclosure comprises a first enclosure portion and a second enclosure portion. A post is coupled to the first enclosure portion for extending through the first and second generally aligned holes of the first and second hasp members to secure the first and second hasp members together and position the first enclosure portion behind the security seal. The second enclosure portion includes an aperture formed therein for receiving the post so that the second enclosure member engages the first enclosure portion and covers the security seal. In this manner, the first enclosure portion and the second enclosure portion cooperate to at least substantially enclose the security seal. A latching member secures the second enclosure portion to the first enclosure to limit unauthorized access to the security seal.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally to FIGS. 1 through 13, an enclosure assembly for enclosing a hasp assembly for securing a locking arm of a cargo door is described. Conventional cargo carrying vehicles and shipping containers having swing-out cargo doors typically include a latching assembly comprised of a vertical locking bar and a horizontally extending locking arm pivotally attached to the vertical locking bar. The vertical locking bar includes a locking cam that engages a corresponding keeper in the frame surrounding the cargo door when the cargo door is closed and the locking arm is in a position parallel with the door. The locking cam is disengaged from the keeper when the locking arm is rotated to a position perpendicular to the cargo door allowing the door to be opened.

Figure 1:
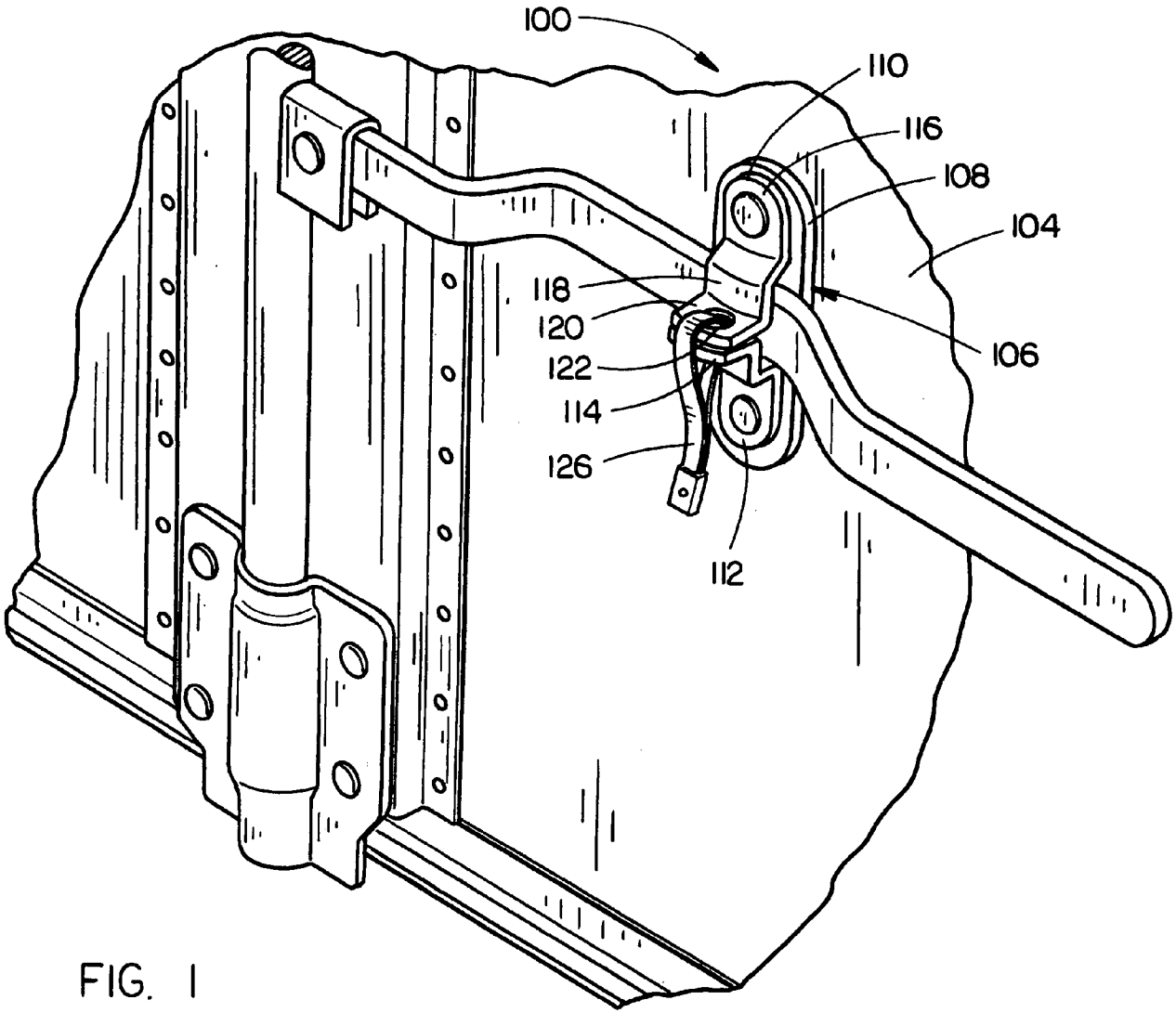
FIG. 1 is a partial isometric view illustrating a locking arm of a cargo door secured by a hasp assembly and a security seal.
Figure 2:
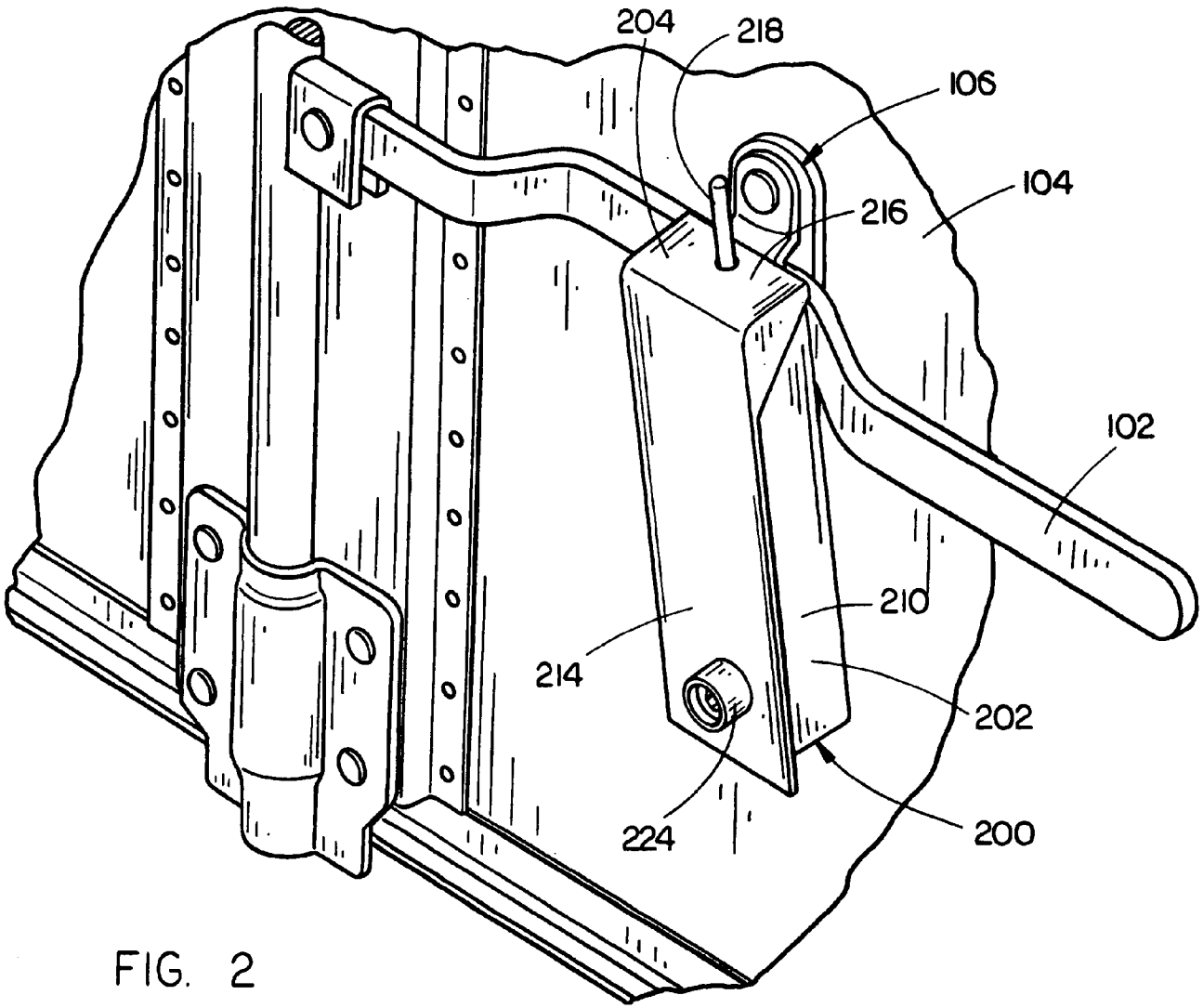
FIG. 2 is a partial isometric view illustrating an enclosure assembly enclosing a security seal and a hasp assembly, for securing a locking arm of a cargo door, wherein the enclosure assembly includes a post and an Allen-head type latching member in accordance with an exemplary embodiment of the present invention.
Figure 3:
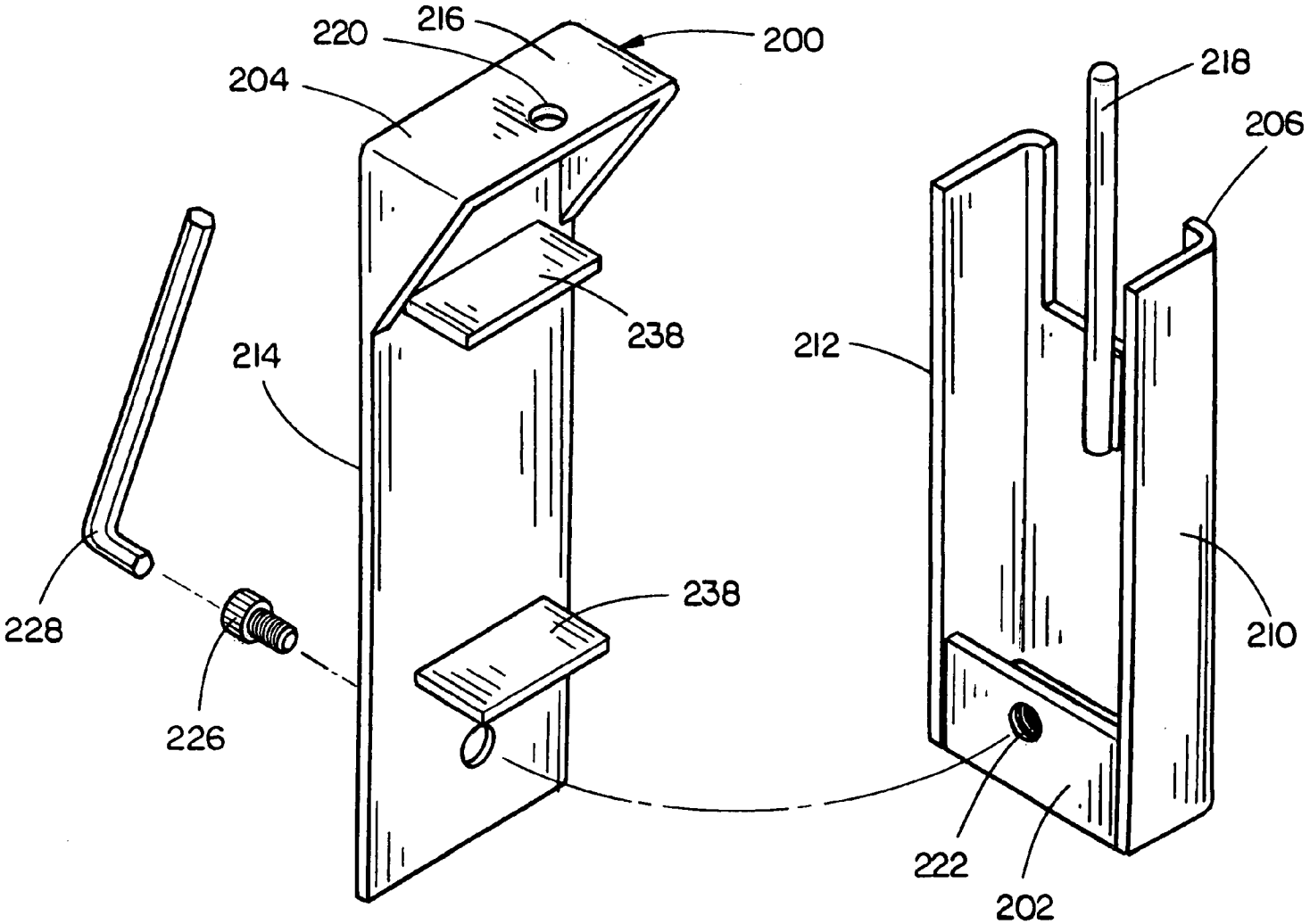
FIG. 3 is an exploded isometric view illustrating the enclosure assembly shown in FIG. 2.
Figure 4:
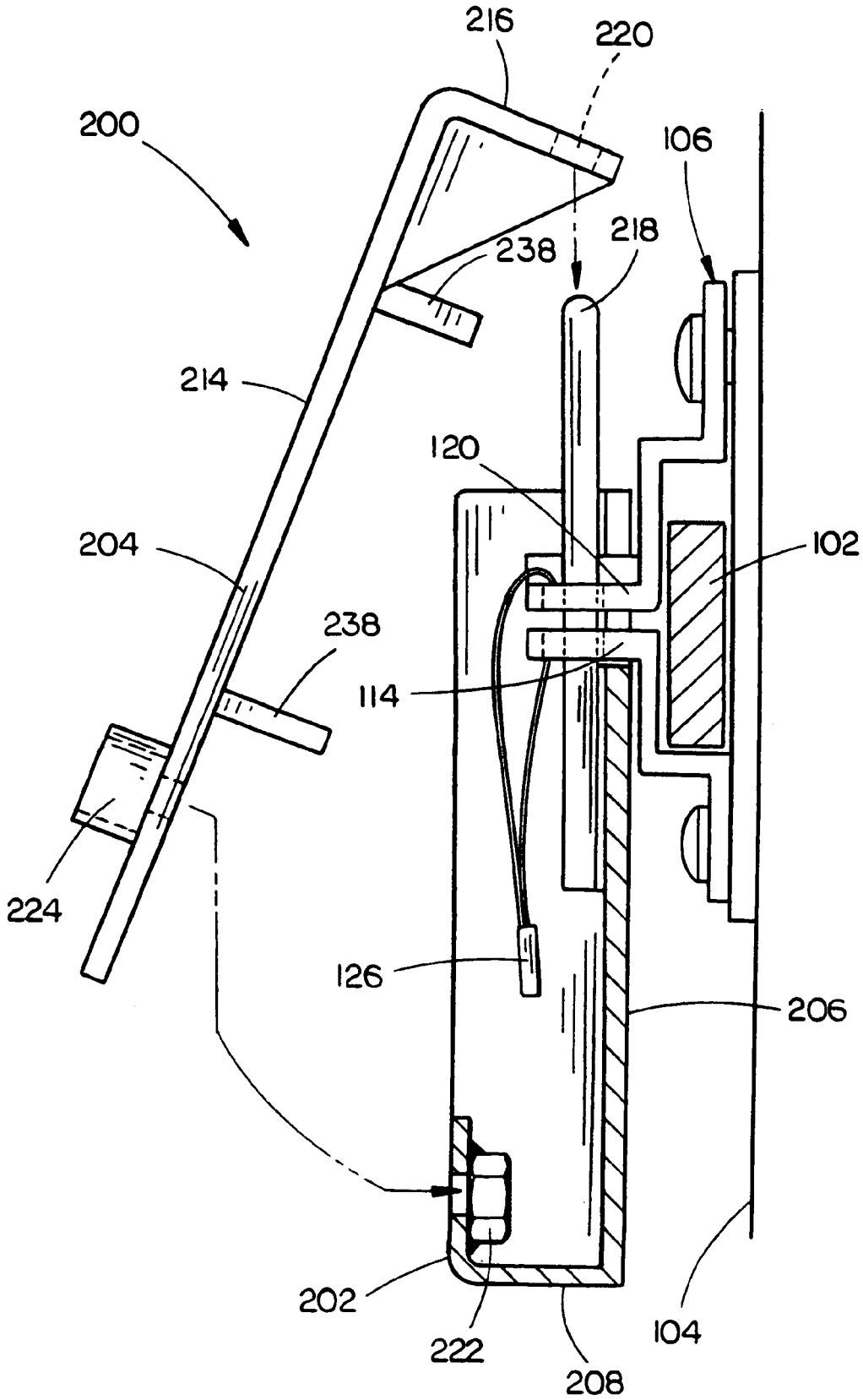
FIG. 4 is a partial cross-sectional side elevation view of the enclosure assembly shown in FIG. 2, wherein a second enclosure portion is disengaged from a first enclosure portion.

Referring now to FIG. 1, the locking arm 102 of the latching assembly 100 is secured in a horizontal position parallel to the cargo door 104 by a hasp assembly 106. The hasp assembly 106 includes a backing plate 108 that is secured to the cargo door 104. Upper and lower hasp members 110 and 112 are connected to the backing plate 108. The lower hasp member 112, or staple, which is stationary, receives and supports the lever arm 102 in a horizontal position (shown) and includes a generally horizontal flange 114 protruding outwardly from the backing plate 108 away from the cargo door 104. The upper hasp member 110 includes an upper end 116 that is pivotally connected to the backing plate 108 so that the upper hasp member 110 pivots or rotates within a plane generally parallel to the cargo door 104. The upper hasp member 110 further includes a lower end 118 that extends over the lever arm 102 when the lever arm 102 is supported by the lower hasp member 112 (shown) and a second generally horizontal flange 120 protruding outwardly from the lower end 118 away from the backing plate 108 and cargo door 104. The horizontal flanges 120 and 114 of the upper and lower hasp members 110 and 112 are provided with aligned holes 122 and 124 (124 not shown) for receiving the shackle of a padlock (not shown) for securing the lever arm 102 within the hasp assembly 106 and preventing the cargo door 104 from being opened.

Where access to the cargo is to be limited, a seal 126 such as a ribbon seal, a padlock seal, a cable seal, or the like is installed through the aligned holes 122 and 124 of the hasp assembly 106. The seal 126 must be broken prior to opening the cargo doors 104; in this manner, unauthorized entry into a cargo container of a cargo carrying vehicle, a shipping container, or the like may be detected by examination of the seal 126.

Referring to FIGS. 2 through 13, an enclosure assembly 200 for enclosing a hasp assembly 106 securing a locking arm 102 of a cargo door 104 in accordance with exemplary embodiments of the present invention is described. The enclosure assembly 200 includes a first enclosure portion 202 and a second enclosure portion 204. The first enclosure portion 202 and the second enclosure portion 204 cooperate to enclose the hasp assembly 106. In the exemplary embodiments shown in the accompanying figures, the first enclosure portion 202 includes a rear member 206, a bottom member 208, and side members 210 and 212. The rear member 206 includes an opening for receiving the hasp assembly 106. The second enclosure portion 202 includes a front member 214 and a top member 216. Together, members 206, 208, 210, 212, 214, and 216 serve to form a rectangular prism type shape for enclosing the hasp assembly 106. Such a rectangular prism type shape may be desirable for reducing the cost of manufacturing or simplifying the construction of an enclosure assembly 200, providing a suitable amount of interior volume for the enclosure assembly 200, or the like. However, those of ordinary skill in the art will appreciate that many other various shapes may be used for the first enclosure portion 202 and the second enclosure portion 204. For example, the first enclosure portion 202 and the second enclosure portion 204 may include rounded or beveled corners, forming a generally circular prism, spherical type shape, or the like. Additionally, many other geometrically irregular or asymmetrical shapes may be used without departing from the scope and intent of the present invention.

The first enclosure portion 202 includes a post 218 for extending through the first and second generally aligned holes 122 and 124 (FIG. 1) of the hasp assembly 106, and through the second enclosure portion 204. The first enclosure portion 202 is seated behind the second enclosure portion 204. The second enclosure portion 204 is constructed with an aperture 220 or the like for encompassing the post 218 when it is seated on and in front of the first enclosure portion 202. Those of ordinary skill in the art will appreciate that the post 218 may be shaped or formed with many different extruded type shapes and thicknesses. For instance, in the exemplary embodiment illustrated in the accompanying drawings, the post 218 has a generally round cross section, matched with a generally round aperture 220 in the second enclosure portion 204. However, it is contemplated that the post 218 may have square, rectangular, triangular, or any number of different alternate cross-sectional shapes, corresponding with differently shaped apertures 220 in the second enclosure portion 204. For example, such an irregular shape may be desirable for aligning the second enclosure portion 204 up with the first enclosure portion 202.

By extending through the first and second generally aligned holes 122 and 124 (FIG. 1) of the hasp assembly 106 and through the second enclosure portion 204, the post 218 of the first enclosure portion 202 serves to securely fasten the generally horizontal flanges 114 and 120 of the hasp assembly 106 together, securing the locking arm 102 in position. When a security seal 126 has been affixed through the first and second generally aligned holes 122 and 124 (FIG. 1) of the hasp assembly 106, the enclosure assembly 200 protects the integrity of the security seal 126 by substantially enclosing the security seal 126 and adding the additional securing function of the post 218 through the hasp assembly 106. It is contemplated that the size and shape of the enclosure assembly 200 may be selected to at least substantially enclose the security seal 126. For instance, the enclosure assembly 200 may be formed or manufactured to secure a wide variety of security seals of various shapes and sizes. Additionally, the post 218 may be formed to support the enclosure assembly 200 while it substantially encloses the security seal 126, or the post 218 may be formed of a sturdier and/or more substantial material for providing additional securing force for affixing the first and second generally aligned holes 122 and 124 (FIG. 1) of the hasp assembly 106 together and preventing accidental breakage of the security seal. Such an arrangement may have the added advantage of allowing the use of a security seal which heretofore may have been unallowable because of a lack of strength of said seal. It is further contemplated that a seal may be added to the enclosure assembly 200 providing for the possibility of more than one seal for the cargo door 104.

Referring now to FIGS. 2 through 5, an enclosure assembly 200 including an Allen-head type latching member is described in accordance with exemplary embodiments of the present invention. The Allen-head type latching member includes a threaded aperture 222, such as the nut shown in the present embodiment, included with the first enclosure portion 202, and a bolt guard assembly 224 included with the second enclosure portion 204. Those of ordinary skill in the art will appreciate that the threaded aperture 222 may be attached to the first enclosure portion 202 or formed as part of the first enclosure portion without departing from the scope and spirit of the present invention. An Allen-head type fastener 226, such as the bolt including the Allen-type bolt head shown in the current embodiment, is included for being inserted into the bolt guard assembly 224 of the second enclosure portion 204 and threaded through the threaded aperture 222 of the first enclosure portion 202. An Allen wrench 228 or the like may be used to thread the Allen-head type fastener into the threaded aperture 222. The Allen-head type latching member serves to lock the first enclosure portion 202 securely to the second enclosure portion 204, preventing disengagement of the generally horizontal flanges 114 and 120 of the hasp assembly 106 and protecting the seal 126. Those of ordinary skill in the art will appreciate that many various fastener types may be used without departing from the scope and intent of the present invention. For instance, a head-head type fastener, a fastener with a head for engaging with a standard type screwdriver, or the like may be provided.

Figure 5:
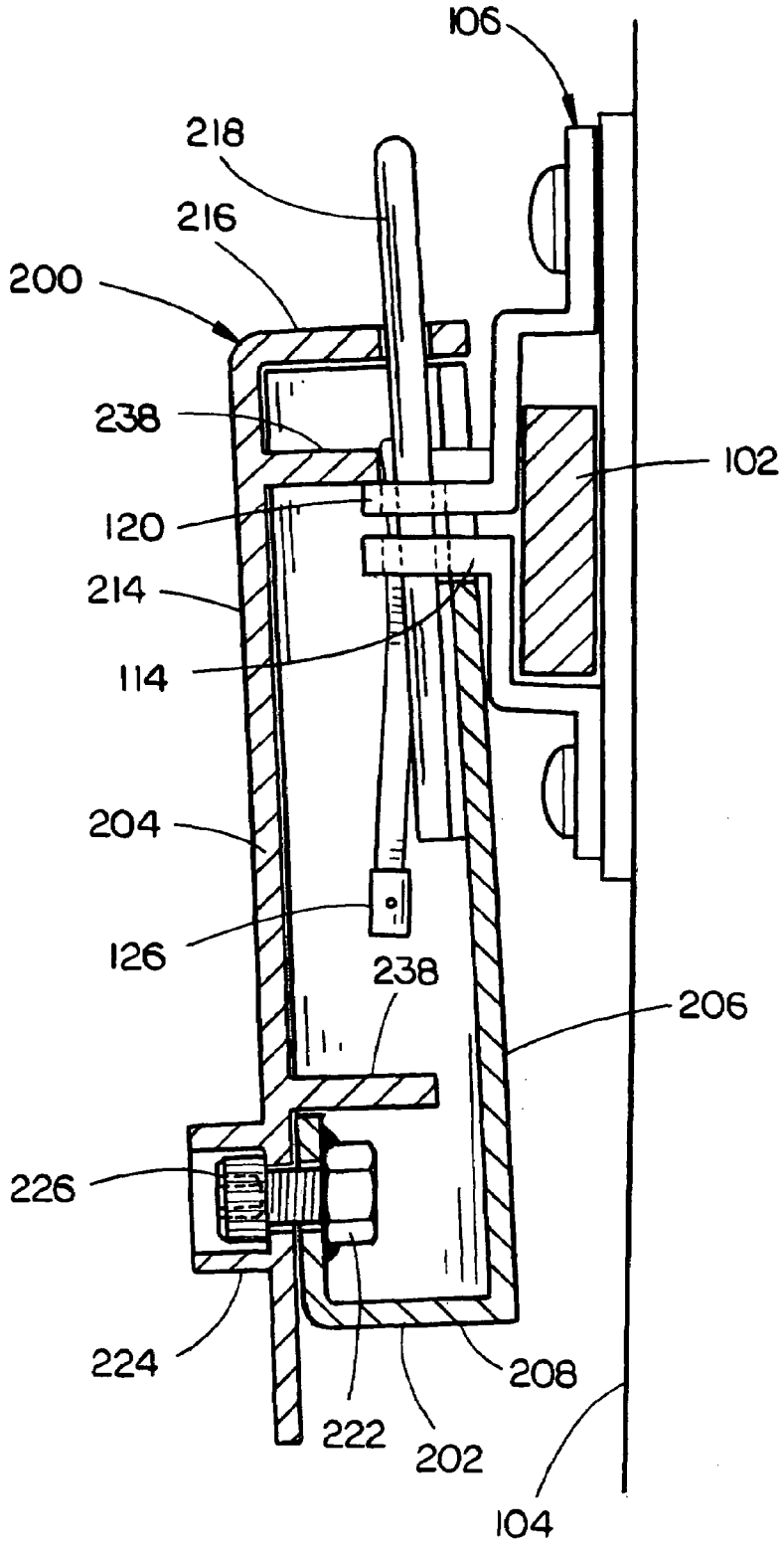
FIG. 5 is a partial cross-sectional side elevation view of the enclosure assembly shown in FIG. 2, wherein the second enclosure portion is engaged with the first enclosure portion via the post and the Allen-head type latching member.
Figure 6:
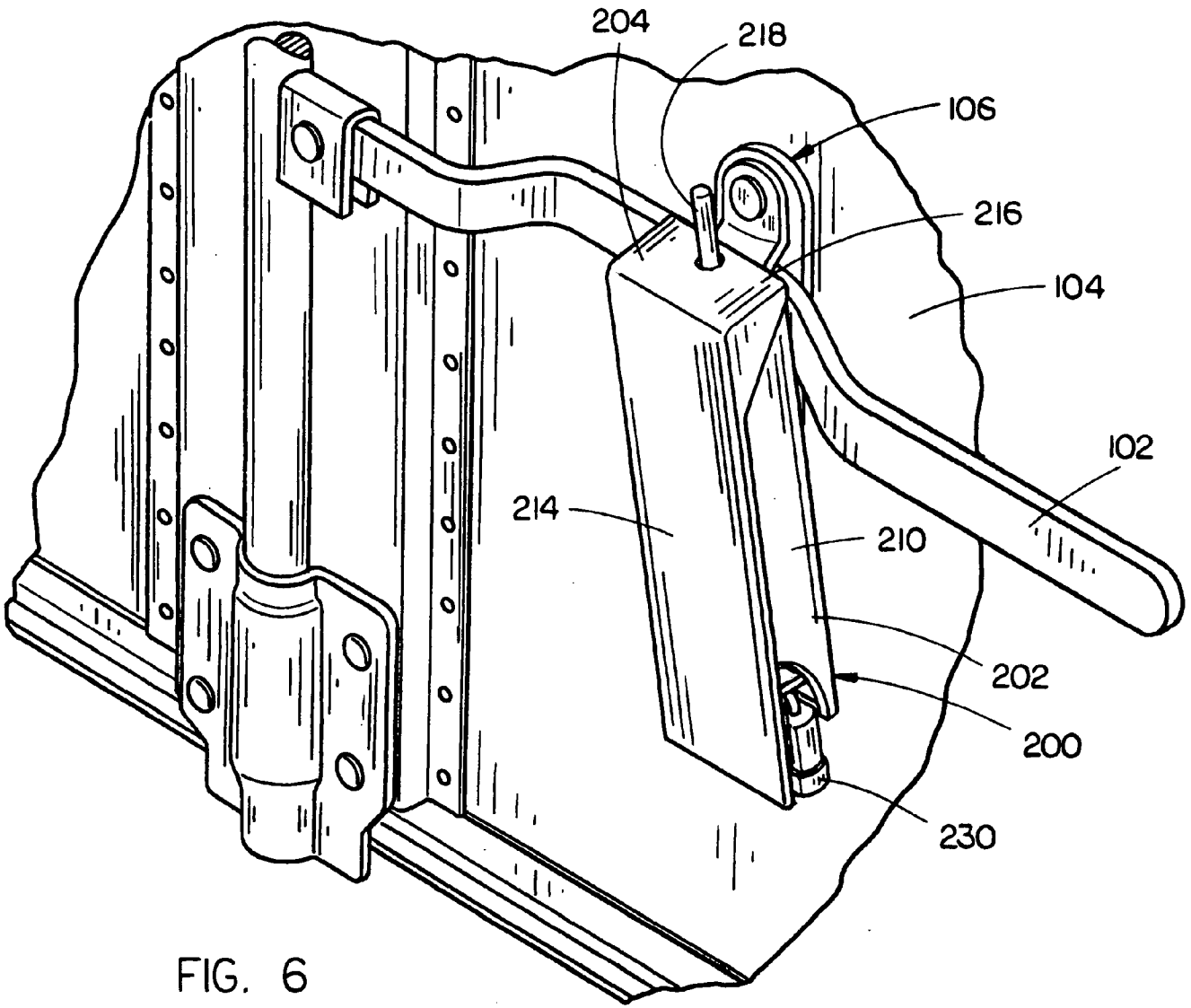
FIG. 6 is a partial isometric view illustrating an enclosure assembly enclosing a security seal and a hasp assembly, for securing a locking arm of a cargo door, wherein the enclosure assembly includes a post and a padlock type latching member in accordance with an exemplary embodiment of the present invention.
Figure 7:
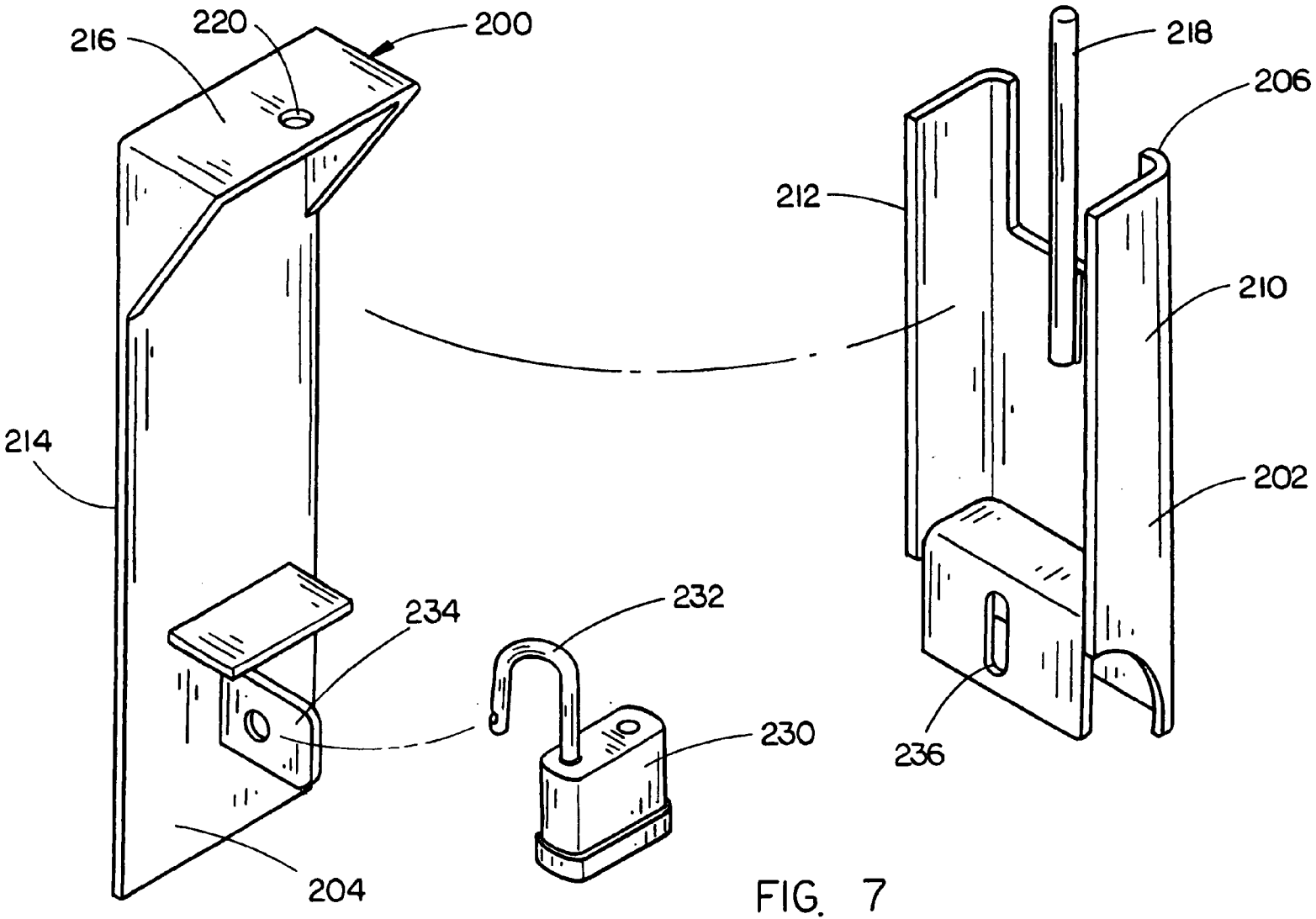
FIG. 7 is an exploded isometric view illustrating the enclosure assembly shown in FIG. 6.
Figure 8:
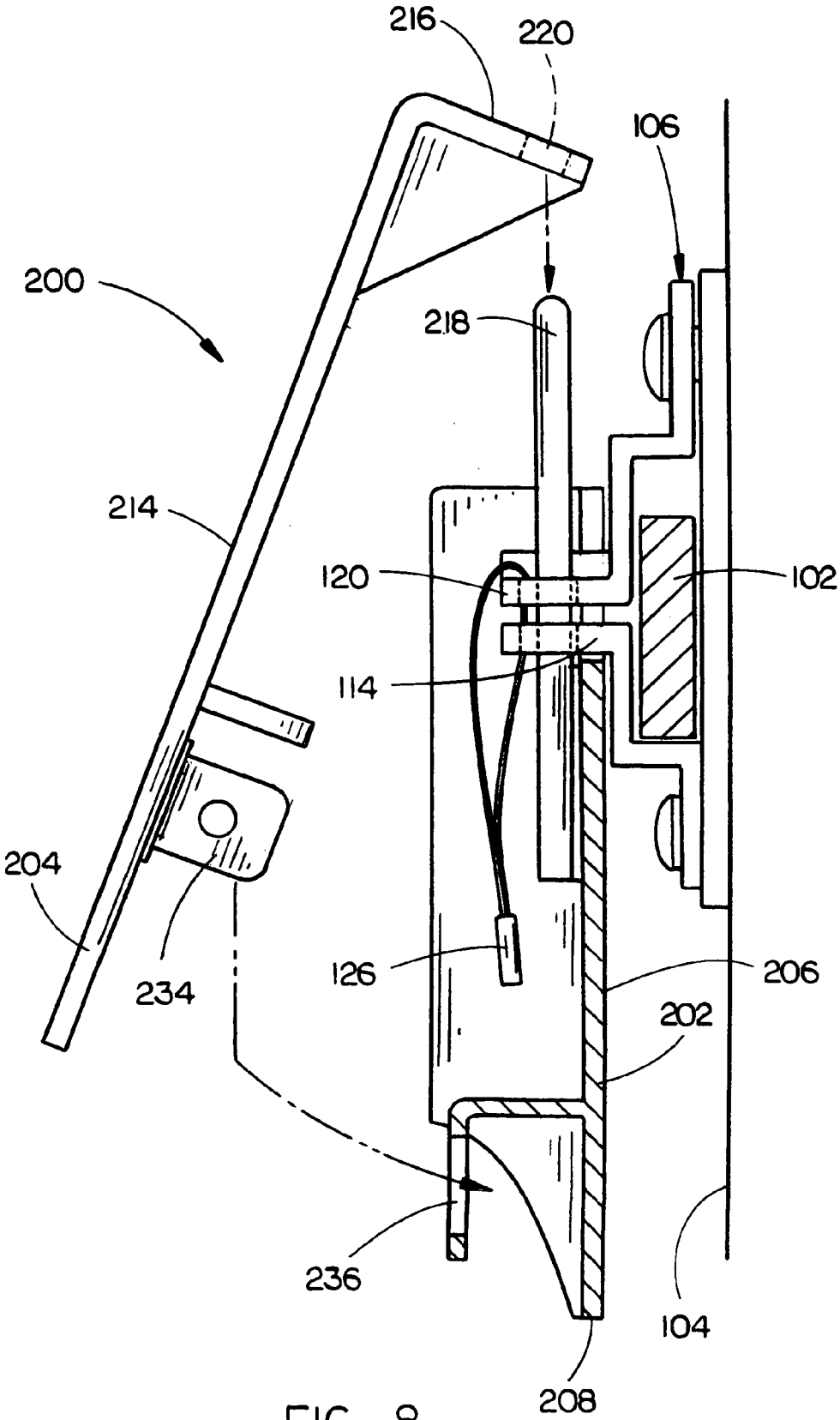
FIG. 8 is a partial cross-sectional side elevation view of the enclosure assembly shown in FIG. 6, wherein a second enclosure portion is disengaged from a first enclosure portion.
Figure 9:
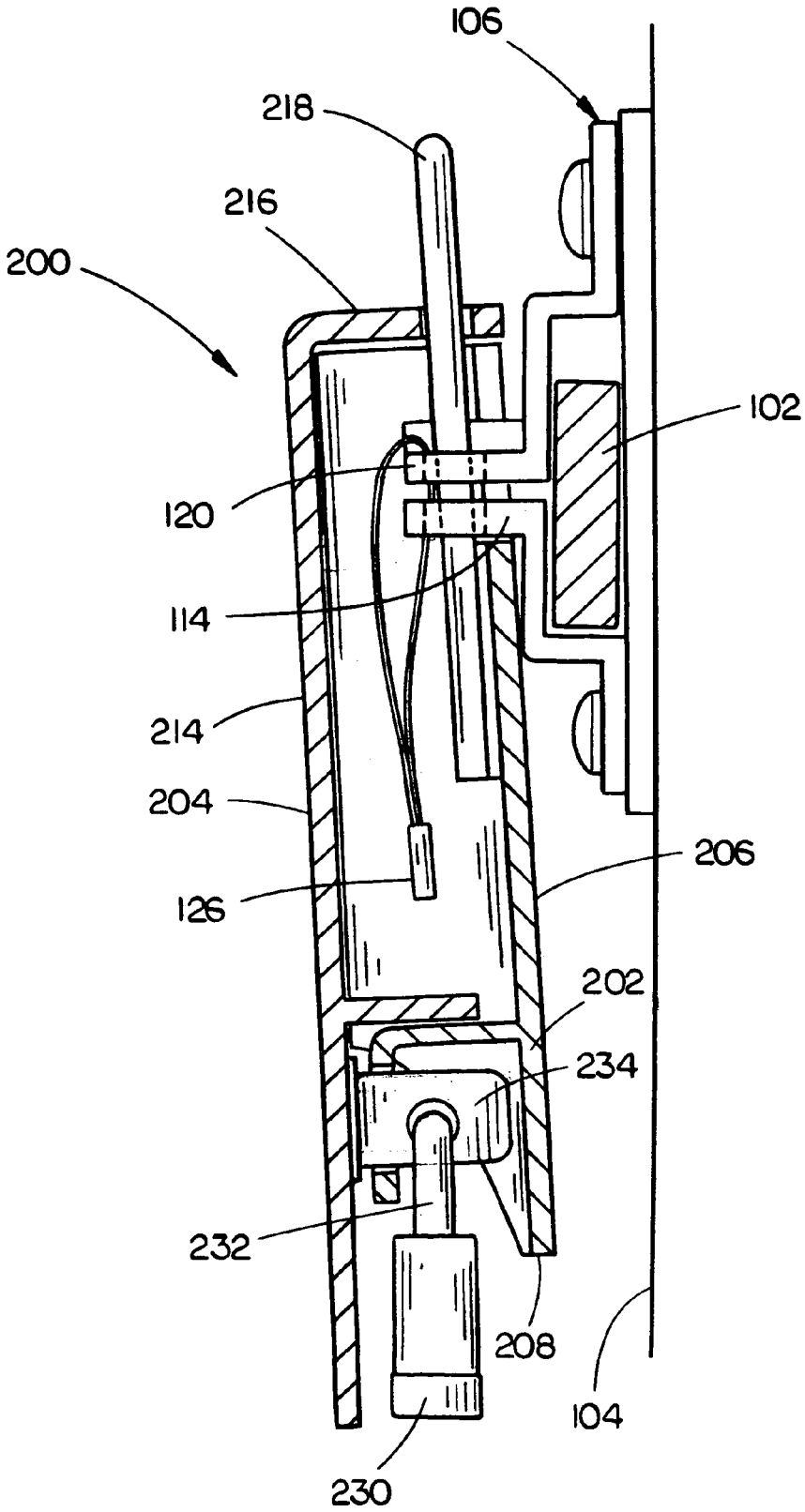
FIG. 9 is a partial cross-sectional side elevation view of the enclosure assembly shown in FIG. 6, wherein the second enclosure portion is engaged with the first enclosure portion via the post and the padlock type latching member.
Figure 10:
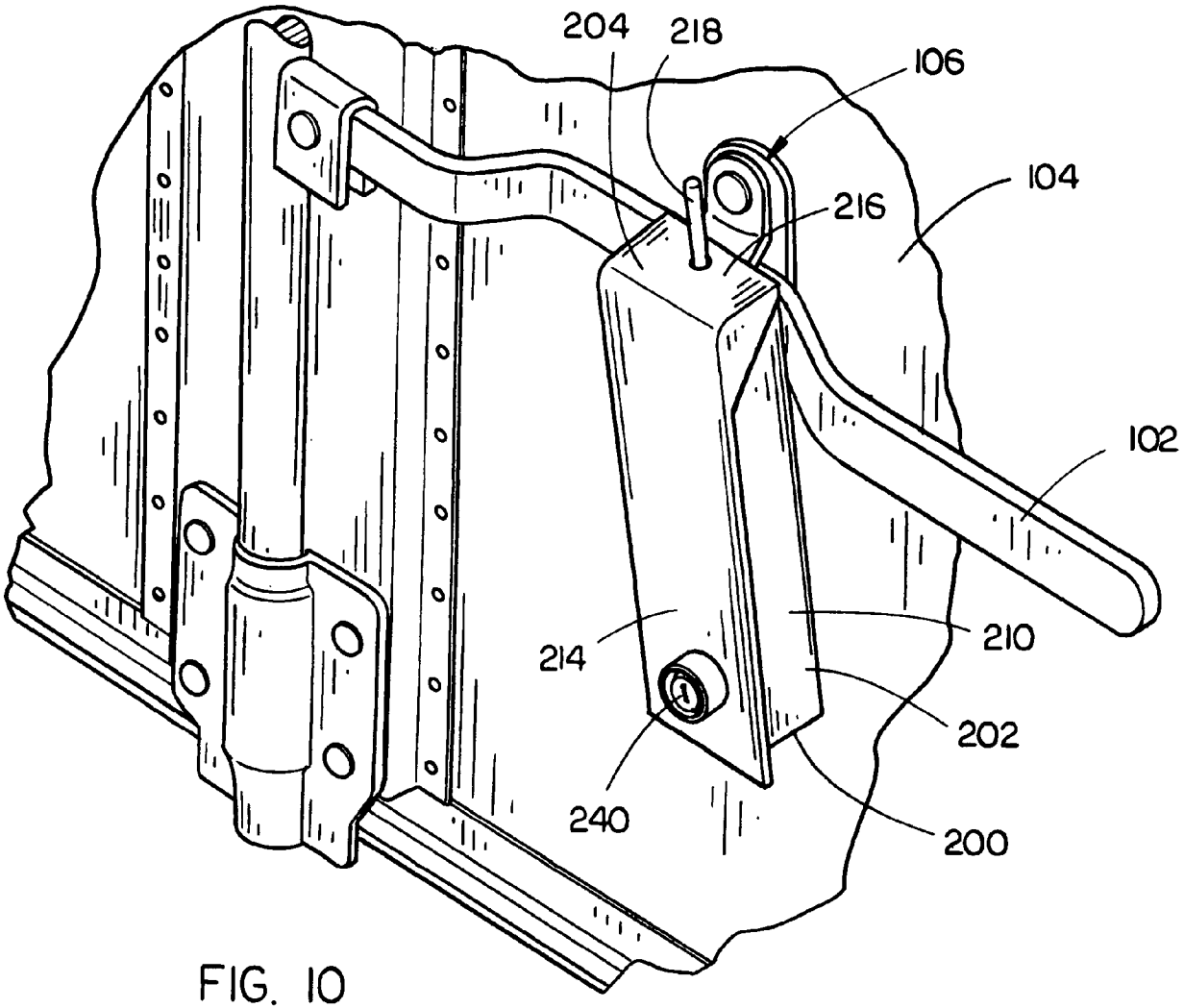
FIG. 10 is a partial isometric view illustrating an enclosure assembly enclosing a security seal and a hasp assembly, for securing a locking arm of a cargo door, wherein the enclosure assembly includes a post and a key lock type latching member in accordance with an exemplary embodiment of the present invention.
Figure 11:
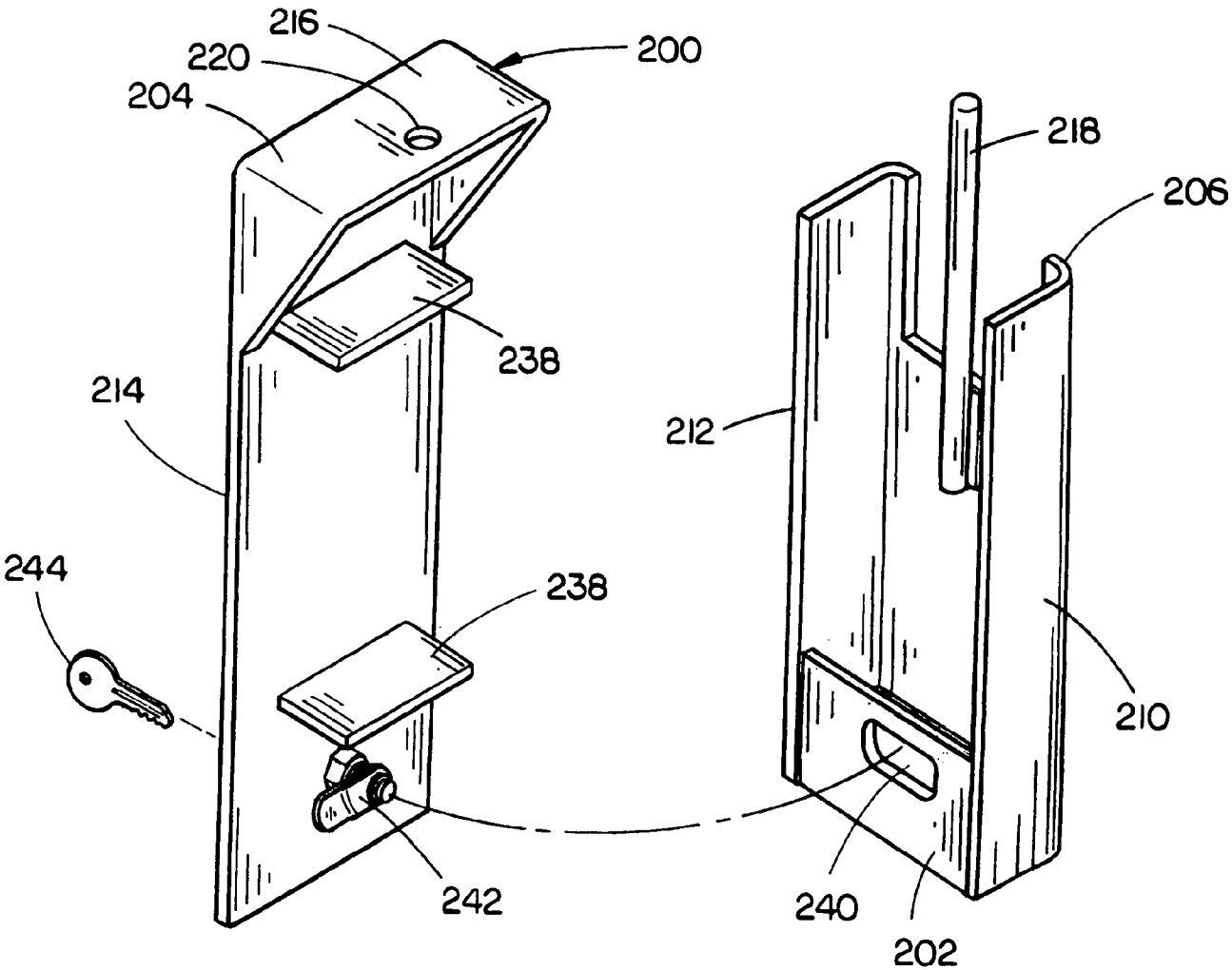
FIG. 11 is an exploded isometric view illustrating the enclosure assembly shown in FIG. 10.
Figure 12:
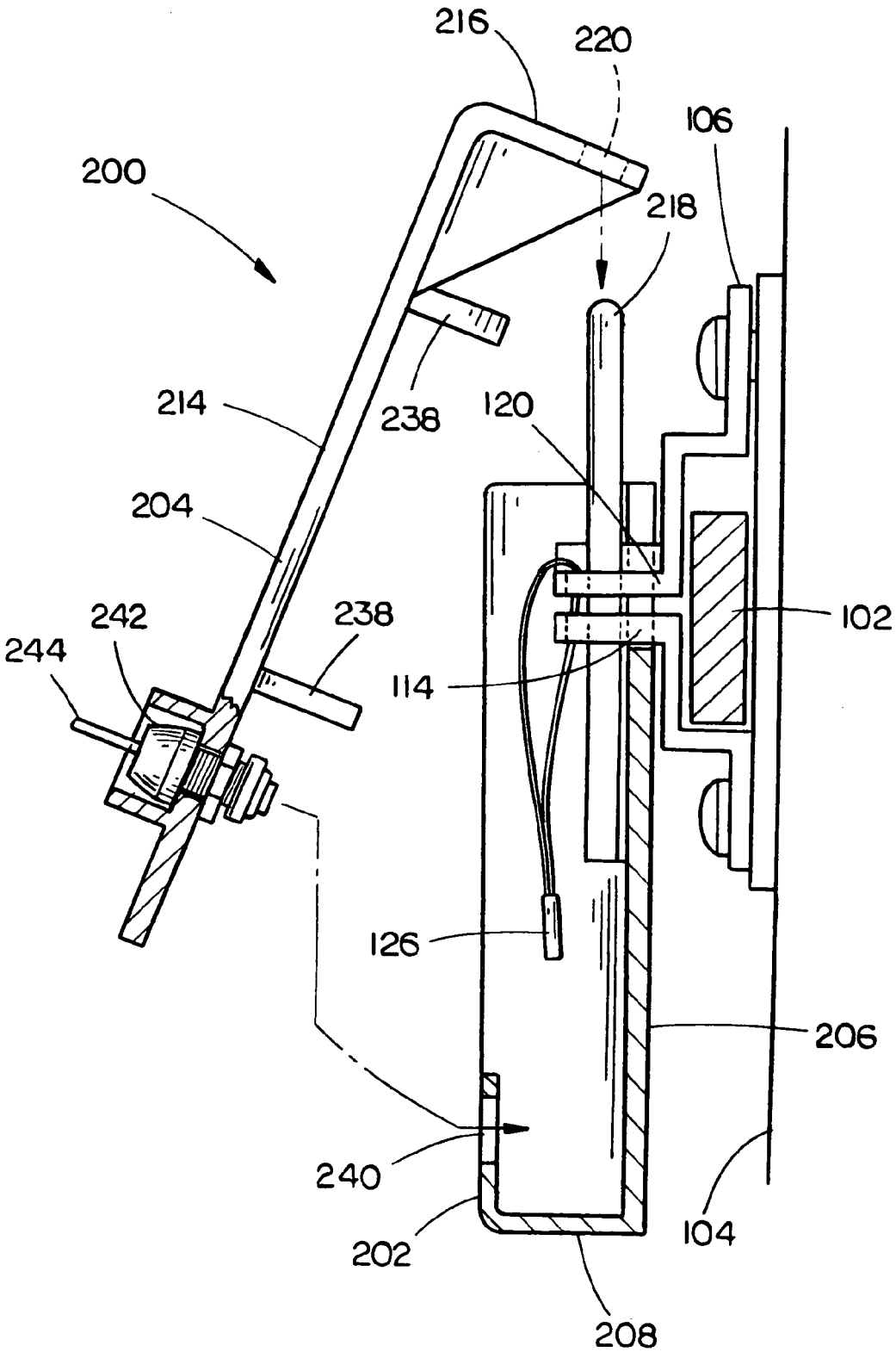
FIG. 12 is a partial cross-sectional side elevation view of the enclosure assembly shown in FIG. 10, wherein a second enclosure portion is disengaged from a first enclosure portion.

Retaining tabs 238 may be included with the second side portion 204 for either of locking the second side portion 204 in place relative to the first side portion 204 or locking the enclosure assembly 200 in place relative to the hasp assembly 106. By placing a retaining tab above the hasp assembly 106, as shown in FIG. 5, the enclosure assembly 200 may be prevented from being pushed up against the security seal 126. It is contemplated that a number of different retaining tab geometries and configurations may be used for preventing movement of the enclosure assembly 200, the first side portion 202, and the second side portion 204.

Referring now to FIGS. 6 through 9, an enclosure assembly 200 including a padlock type latching member is described in accordance with exemplary embodiments of the present invention. The padlock type latching member includes a padlock 230 having a hinged, U-shaped bar 232 or the like for insertion through a hasp 234 connected to the second enclosure portion 204. The bottom member 208 of the first enclosure portion 202 includes a slot 236 through which the hasp 234 is inserted upon engagement of the second enclosure portion 202 with the first enclosure portion 204. After the hasp 234 has been inserted through the slot 236, the hinged, U-shaped bar 232 of the padlock 230 is inserted through the hasp 234 and then snapped shut in the body of the padlock 230. The padlock type latching member serves to lock the first enclosure portion 202 securely to the second enclosure portion 204, preventing disengagement of the generally horizontal flanges 114 and 120 of the hasp assembly 106 and protecting the seal 126. Those of ordinary skill in the art will appreciate that many various padlock types may be used without departing from the scope and intent of the present invention.

Referring now to FIGS. 10 through 13, an enclosure assembly 200 including a key lock type latching member is described in accordance with exemplary embodiments of the present invention. The key lock type latching member includes a keyed latch 240 included with the first enclosure portion 202, and a latch receiving assembly 242 included with the second enclosure portion 204. Those of ordinary skill in the art will appreciate that the keyed latch 240 may be attached to the first enclosure portion 202 or formed as part of the first enclosure portion without departing from the scope and spirit of the present invention. A key 244 is inserted into the keyed latch 240 of the first enclosure portion 202 and rotated within the keyed latch 240 for alternately engaging and releasing the latch of the keyed latch 240 from the latch receiving assembly 242 of the second enclosure portion 204. The key lock type latching member serves to lock the first enclosure portion 202 securely to the second enclosure portion 204, preventing disengagement of the generally horizontal flanges 114 and 120 of the hasp assembly 106 and protecting the seal 126. Those of ordinary skill in the art will appreciate that various key lock types and configurations may be used without departing from the scope and intent of the present invention. For instance, the keyed latch 240 may be included as part of the second enclosure portion 204, while the latch receiving assembly 242 may be included as part of the first enclosure portion 202, or the like.

Figure 13:
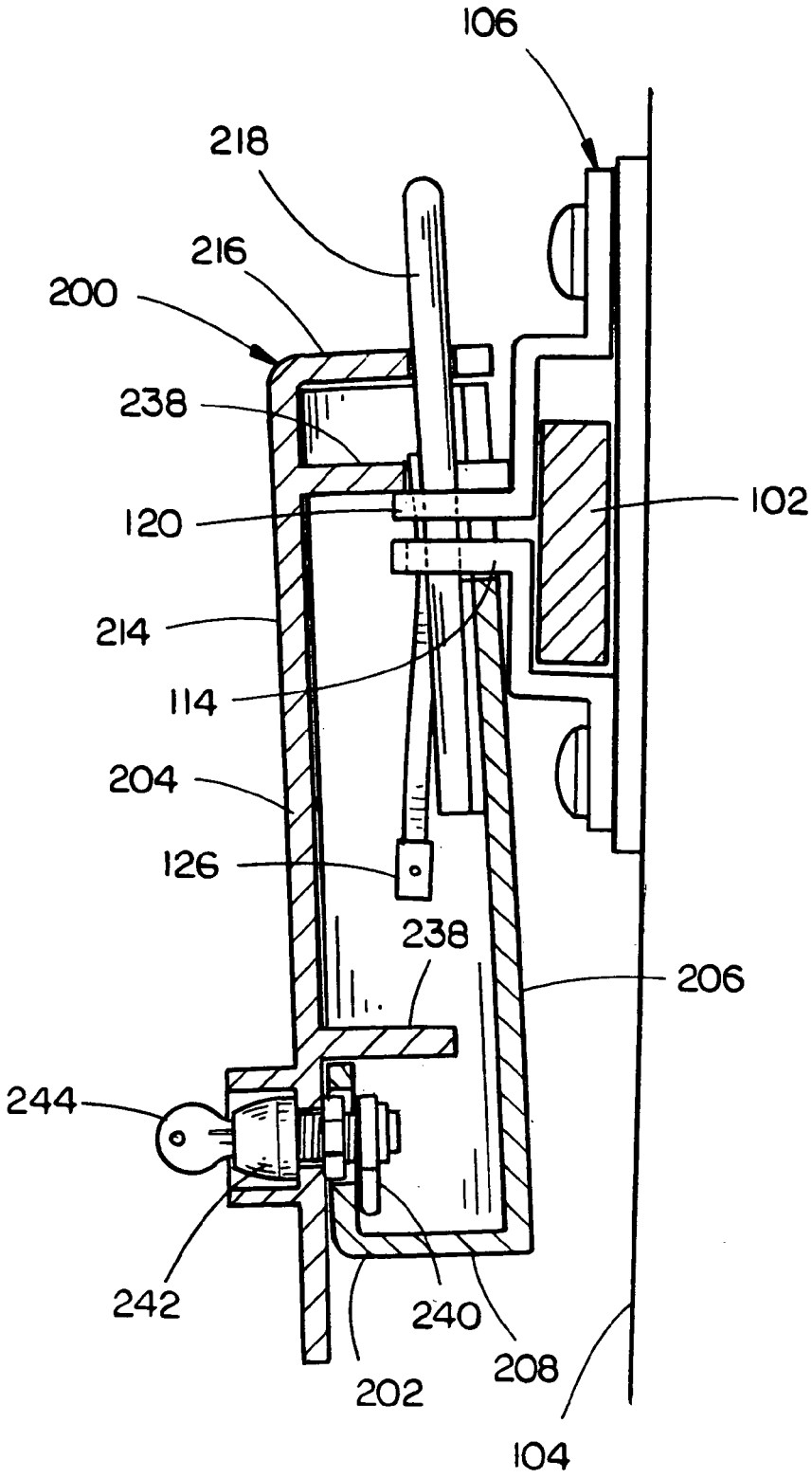
FIG. 13 is a partial cross-sectional side elevation view of the enclosure assembly shown in FIG. 10, wherein the second enclosure portion is engaged with the first enclosure portion via the post and the key lock type latching member.

Retaining tabs 238 may be included with the second side portion 204 for either of locking the second side portion 204 in place relative to the first side portion 204 or locking the enclosure assembly 200 in place relative to the hasp assembly 106. By placing a retaining tab above the hasp assembly 106, as shown in FIG. 13, the enclosure assembly 200 may be prevented from being pushed up against the security seal 126. It is contemplated that a number of different retaining tab geometries and configurations may be used for preventing movement of the enclosure assembly 200, the first side portion 202, and the second side portion 204.

Based on the discussion of FIGS. 1–13, it will be appreciated by those of ordinary skill in the art that seal enclosure assemblies in accordance with the present invention may employ latching members having locks or latches other than those specifically disclosed herein. For example, instead of a keyed latch 240 as shown in FIGS. 10 through 13, an exemplary enclosure assembly in accordance with the present invention may comprise a latching member employing a combination lock, a latching member employing an electronic lock which may be unlocked and/or locked by a keypad into which a identification code may be entered, or the like.

It is believed that the enclosure assembly of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An enclosure assembly for enclosing a security seal sealing a hasp assembly having first and second hasp members, the seal extending through generally aligned holes formed in the first and second hasp members, comprising:

a first enclosure portion;

a post coupled to the first enclosure portion for extending through the first and second generally aligned holes of the first and second hasp members;

a second enclosure portion for engaging the post and the first enclosure portion; and a latching member for securing the second enclosure portion to the first enclosure portion, wherein the first enclosure portion and the second enclosure portion cooperate to at least substantially enclose the security seal.

2. The enclosure assembly as claimed in claim 1, wherein the latching member comprises a bolt latching assembly including a bolt, and a threaded aperture provided in the first enclosure portion, wherein the bolt extends through a hole formed in the wall of the second enclosure portion and the first enclosure portion and is threaded into the threaded aperture for securing the second enclosure portion to the first enclosure portion.

3. The enclosure assembly as claimed in claim 2, wherein the second enclosure portion comprises a bolt guard assembly and the bolt comprises a bolt head, the bolt guard assembly for protecting the bolt head.

4. The enclosure assembly as claimed in claim 2, wherein the first enclosure portion includes a rear member having an opening for receiving the hasp assembly, left and right side members for enclosing the security seal and a front member, the threaded aperture being coupled to the front member.

5. The enclosure assembly as claimed in claim 2, wherein the bolt comprises an Allen-headed bolt having a socket for being engaged by an Allen wrench for threading the bolt into the threaded aperture.

6. The enclosure assembly as claimed in claim 5, wherein the socket is a non-standard sized for being engaged by an Allen wrench of a non-standard size.

7. The enclosure assembly as claimed in claim 1, wherein the latching member comprises a hasp coupled to the second enclosure portion, the hasp extending through a slot formed in the first enclosure portion for receiving a padlock for securing the second enclosure portion to the first enclosure portion.

8. The enclosure assembly as claimed in claim 7, wherein the first enclosure portion includes a rear member having an opening for receiving the hasp assembly, left and right side members for enclosing the security seal and a front member, the front member including the slot.

9. The enclosure assembly as claimed in claim 1, wherein the latching member comprises a keyed latching assembly.

10. The enclosure assembly as claimed in claim 9, wherein the keyed latching assembly comprises a keyed latch included with the first enclosure portion, and a latch receiving assembly included with the second enclosure portion.

11. An enclosure assembly for enclosing a security seal sealing a hasp assembly having first and second hasp members, the seal extending though generally aligned holes formed in the first and second hasp members, the enclosure comprising:

a first enclosure portion;

a post coupled to the first enclosure portion for extending through the first and second generally aligned holes of the first and second hasp members to secure the first and second hasp members together and position the first enclosure portion behind the security seal;

a second enclosure portion having an aperture formed therein for receiving the post so that the second enclosure portion engages the first enclosure portion and covers the security seal; and a latching member for securing the second enclosure portion to the first enclosure portion, wherein the first enclosure portion and the second enclosure portion cooperate to at least substantially enclose the security seal.

12. The enclosure assembly as claimed in claim 11 wherein the latching member comprises a bolt latching assembly including a bolt, and a threaded aperture provided in the first enclosure portion, wherein the bolt extends through a hole formed in the wall of the second enclosure portion and the first enclosure portion and is threaded into the threaded aperture for securing the second enclosure portion to the first enclosure portion.

13. The enclosure assembly as claimed in claim 12 wherein the second enclosure portion comprises a bolt guard assembly and the bolt comprises a bolt head, the bolt guard assembly for protecting the bolt head.

14. The enclosure assembly as claimed in claim 12 wherein the first enclosure portion includes a rear member having an opening for receiving the hasp assembly, left and right side members for enclosing the security seal and a front member, the threaded aperture being coupled to the front member.

15. The enclosure assembly as claimed in claim 12 wherein the bolt comprises an Allen-headed bolt having a socket for being engaged by an Allen wrench for threading the bolt into the threaded aperture.

16. The enclosure assembly as claimed in claim 15 wherein the socket is a non-standard sized for being engaged by an Allen wrench of a non-standard size.

17. The enclosure assembly as claimed in claim 11 wherein the latching member comprises a hasp coupled to the second enclosure portion, the hasp extending through a slot formed in the first enclosure portion for receiving a padlock for securing the second enclosure portion to the first enclosure portion.

18. The enclosure assembly as claimed in claim 17 wherein the first enclosure portion includes a rear member having an opening for receiving the hasp assembly, left and right side members for enclosing the security seal and a front member, the front member including the slot.

19. The enclosure assembly as claimed in claim 11 wherein the latching member comprises a keyed latching assembly.

20. The enclosure assembly as claimed in claim 19, wherein the keyed latching assembly comprises a keyed latch included with the first enclosure portion, and a latch receiving assembly included with the second enclosure portion.

21. An enclosure for enclosing a security seal sealing a hasp assembly having first and second hasp members, the seal extending though generally aligned holes formed in the first and second hasp members, the enclosure comprising:

first means for enclosing the security seal;

means, coupled to the first enclosing means and extending through the first and second generally aligned holes of the first and second hasp members for securing the first enclosing means to the hasp assembly;

second means for enclosing the security seal, the second enclosing means engaging the securing means and the first enclosing means; and means for latching the second enclosing means to the first enclosing means, wherein the first enclosing means and the second enclosing means cooperate to at least substantially enclose the security seal.

22. A method for enclosing a security seal sealing a hasp assembly having first and second hasp members, the seal extending though generally aligned holes formed in the first and second hasp members, the method comprising:

installing a first enclosure portion to the hasp assembly by inserting a post coupled to the first enclosure portion through the first and second generally aligned holes of the first and second hasp members so that the first enclosure portion is positioned behind the security seal;

engaging a second enclosure portion with the post and the first enclosure portion so that the second enclosure portion covers the security seal; and engaging a latching member for securing the second enclosure portion to the first enclosure portion, wherein the first enclosure portion and the second enclosure portion cooperate to at least substantially enclose the security seal.

23. The method as claimed in claim 22, wherein the latching member comprises a bolt latching assembly including a bolt and a threaded aperture provided in the first enclosure portion, the bolt extending through a hole formed in the wall of the second enclosure portion and the first enclosure portion, and wherein the step of engaging the latching member further comprises threading the bolt into the threaded aperture for securing the second enclosure portion to the first enclosure portion.

24. The method as claimed in claim 22, wherein the latching member comprises a hasp coupled to the second enclosure portion, the hasp extending through a slot formed in the first enclosure portion, and wherein the step of engaging the latching member further comprises extending the hasp through the slot and attaching a padlock to the hasp for securing the second enclosure portion to the first enclosure portion.

25. The enclosure assembly as claimed in claim 22, wherein the latching member comprises a keyed latching assembly for being locked using a key, and wherein the step of engaging the latching member further comprises locking the keyed latching assembly using the key.

* * * * *